US007936350B2

(12) United States Patent
Nakamura et al.

(10) Patent No.: US 7,936,350 B2
(45) Date of Patent: May 3, 2011

(54) DISPLAY CONTROL CIRCUIT AND DISPLAY SYSTEM

(75) Inventors: Mika Nakamura, Osaka (JP); Hiroki Taoka, Osaka (JP)

(73) Assignee: Panasonic Corporation, Osaka (JP)

( * ) Notice: Subject to any disclaimer, the term of this patent is extended or adjusted under 35 U.S.C. 154(b) by 845 days.

(21) Appl. No.: 11/887,253

(22) PCT Filed: Mar. 16, 2006

(86) PCT No.: PCT/JP2006/305225

§ 371 (c)(1),
(2), (4) Date: Sep. 27, 2007

(87) PCT Pub. No.: WO2006/112229

PCT Pub. Date: Oct. 26, 2006

(65) Prior Publication Data

US 2009/0109207 A1 Apr. 30, 2009

(30) Foreign Application Priority Data

Apr. 15, 2005 (JP) ..... 2005-117898

(51) Int. Cl.
*G09G 5/00* (2006.01)

(52) U.S. Cl. ..... 345/213; 345/99

(58) Field of Classification Search ..... 345/204–214, 345/690–699, 87–103, 76–83, 60–72
See application file for complete search history.

(56) References Cited

U.S. PATENT DOCUMENTS 5,373,310 A * 12/1994 Ichimura et al. ..... 345/98
5,767,862 A 6/1998 Krishnamurthy et al.

FOREIGN PATENT DOCUMENTS

| | | |
|---|---|---|
| JP | 55-35637 | 3/1983 |
| JP | 4-121785 | 4/1992 |
| JP | 11-272227 | 10/1999 |
| JP | 2000-506626 | 5/2000 |

OTHER PUBLICATIONS

International Search Report issued Apr. 25, 2006 in the International (PCT) Application of which the present application is the U.S. National Stage.

* cited by examiner

*Primary Examiner* — Stephen G Sherman
(74) *Attorney, Agent, or Firm* — Wenderoth, Lind & Ponack, L.L.P.

(57) ABSTRACT

In a display control circuit for controlling a display of a display device, data which is stored in a memory is inputted to a FIFO circuit by a DMA controller, and the FIFO circuit transmits the stored data to the display device at a rising edge of an inputted clock PCLK. A clock mask circuit transmits the inputted clock PCLK to the display device as a display clock PCLK' while the FIFO circuit is not underflow. On the other hand, the clock mask circuit masks the inputted clock PCLK while the FIFO circuit is underflow, and transmits the display clock PCLK' whose level is kept high to the display device. As a result, a display position of display data does not shift even if underflow occurs in the FIFO circuit.

3 Claims, 10 Drawing Sheets

DISPLAY CONTROL CIRCUIT AND DISPLAY SYSTEM

TECHNICAL FIELD

The present invention relates to a display control circuit and a display system- for controlling a display of a display device.

BACKGROUND ART

Conventionally, data of each frame of digital terrestrial broadcasting is stored in a memory, and the data of each frame accumulated in the memory is transferred to a buffer circuit in a display control circuit by a DMA (Direct Memory Access) controller to be accumulated once. The display control circuit transmits a clock signal to a display device, and transmits the data for one pixel accumulated in the buffer circuit to the display device at an edge (such as a rising edge) of the clock signal. The display device loads the data inputted from the buffer circuit in the display control circuit at the edge of the clock signal to display the loaded data in a display.

The display device updates a display position of the display at the edge of the clock signal even if data to be transmitted to the display device is not stored in the buffer circuit in the display control circuit. Therefore, if no data to be transmitted to the display device is stored in the buffer circuit in the display control circuit while data is displayed, the data would be displayed in a display position which shifts from an original display position in which the data is to be displayed, for a clock number corresponding to a period for which no data to be transmitted to the display device is stored. The outline is shown in FIG. 10. Note that hereinafter, the state in which no data to be transmitted to the display device is stored in the buffer circuit is referred to as underflow.

FIG. 10A is a display image example when underflow does not occur, and FIG. 10B is a display image example when underflow occurs. As shown in FIG. 10B, when underflow occurs, a display position of a display image after an underflow occurrence position shifts from an original display position.

Therefore, a double buffer structure in which two memory areas for storing data for one frame in a memory is generally employed (refer to a patent document 1, for example). While data for one frame which is a display target for a display is displayed, data for next one frame is stored in a memory area which is different from a memory area in which the display target data is stored. This prevents a situation in which there is no data stored in a memory, which is to be transmitted to the buffer circuit in the display control circuit, and suppresses the occurrence of underflow.

Patent Document 1: Japanese Published Patent Application No. S58-35637

SUMMARY OF THE INVENTION

Problems the Invention is going to Solve

However, if a CPU (Central Processing Unit), a CG (Character Generation), and the like which are other than a DMA controller access a memory, a data transfer speed from the memory to the DMA controller slows down. In this case, even if data, which is to be transmitted to a buffer circuit in a display control circuit, is stored in the memory, there is a case in which underflow occurs in the buffer circuit. Therefore, it is not necessarily true that the occurrence of a display image shift can be prevented.

In view of this, an object of the present invention is to provide a display control circuit and a display system which can prevent the occurrence of a display image shift.

Means of Solving the Problems

The above-mentioned object can be achieved by a display control circuit for controlling a display of a display device, the display control circuit comprising: a data transfer circuit that stores data which is sequentially inputted thereto and transmits the stored data to the display device in accordance with an inputted clock signal; and a clock mask circuit that transmits the inputted clock signal to the display device as a display clock signal while data to be transmitted is stored in the data transfer circuit, and transmits an edge-masked and fixed level signal to the display device as the display clock signal while no data to be transmitted is stored in the data transfer circuit.

Effects of the Invention

With the above-stated construction of the display control circuit, the display control circuit transmits the inputted clock signal to the display device as the display clock signal while data to be transmitted is stored in the data transfer circuit. Also, the display control circuit transmits the edge-masked and fixed level signal to the display device as the display clock signal while no data to be transmitted is stored in the data transfer circuit to eliminate an edge of the display clock signal. Therefore, in the display device which loads data at the edge of the inputted display clock signal to display the loaded display data, the display position is not updated while no data to be transmitted is stored in the data transfer circuit, and a display image shift can be prevented.

The above-stated display control circuit further comprises a clock counter circuit that performs a count operation of counting a number of clocks of the inputted clock signal while data to be transmitted is stored in the data transfer circuit, and stops the count operation while no data to be transmitted is stored in the data transfer circuit; and a horizontal synchronizing signal generating circuit that generates a horizontal synchronizing signal having a first level when a counter value of the clock counter circuit is in a predetermined range and a second level when the counter value is out of the predetermined range, the first level being different from the second level, and transmits the generated horizontal synchronizing signal to the display device.

With the above-stated construction, while the display clock signal is fixed, the counter value of the clock counter circuit which is used for generating the horizontal synchronizing signal is not updated. Therefore, if no data to be transmitted is stored in the data transfer circuit, a timing of horizontal synchronization does not shift in the display device.

The above-stated display control circuit further comprises a mask period counter circuit that counts the number of clocks of the inputted clock signal while no data to be transmitted is stored in the data transfer circuit; and a correcting circuit that corrects an upper limit value in a count range of the clock counter circuit, to a value obtained by subtracting a counter value of the mask period counter circuit from the upper limit value, wherein the clock counter circuit performs the count operation in a count range determined as a result of the correction by the correcting circuit.

With the above-stated construction, the clock counter circuit stops the count operation while no data to be transmitted is stored in the data transfer circuit. However, the clock number for the period is counted, and the upper limit of the count range of the clock count circuit is corrected so as to be smaller by the clock number. Therefore, if no data to be transmitted is stored in the data transfer circuit, a period of horizontal synchronization can be constant in the display device. In particular, this display control device is effective when display data is required to be updated at a constant speed.

The above-stated display control circuit is capable of switching an operation between a first operation and a second operation, the operation being performed while no data to be transmitted is stored in the data transfer circuit, and further comprises: an operation setting circuit that records any of information indicating the first operation and information indicating the second operation, wherein while no data to be transmitted is stored in the data transfer circuit, the clock mask circuit transmits the edge-masked and fixed level signal to the display device as the display clock signal when the information indicating the first operation is recorded in the operation setting circuit, and transmits the inputted clock signal to the display device as the display clock signal when the information indicating the second operation is recorded in the operation setting circuit.

With the above-stated construction, if no data to be transmitted is stored in the data transfer circuit, the first operation for masking the inputted clock signal and the second operation for not masking the inputted clock signal can be set. Therefore, in any case of the first operation and the second operation, the same display control circuit can be used, and the improvement of cost performance can be expected.

A display system of the present invention comprises a display unit, a display control unit operable to control a display of the display unit, a data recording unit operable to record data to be displayed in the display unit in a part of a recording area, and a data reading unit operable to read the data from the data recording unit and transmits the read data to the display control unit, wherein the display control unit includes: a data transfer unit operable to store the data which is sequentially inputted thereto from the data reading unit and transmit the stored data to the display unit in accordance with an inputted clock signal; and a clock mask unit operable to transmit the inputted clock signal to the display unit as a display clock signal while data to be transmitted is stored in the data transfer unit, and transmit an edge-masked and fixed level signal to the display unit as the display clock signal while no data to be transmitted is stored in the data transfer unit.

With the above-stated construction of the display system, the display control unit transmits the inputted clock signal to the display unit as the display clock signal while data to be transmitted is stored in the data transfer unit. Also, the display control unit transmits the edge-masked and fixed level signal to the display unit as the display clock signal while no data to be transmitted is stored in the data transfer unit to eliminate an edge of the display clock signal. Therefore, in the display unit which loads data at the edge of the inputted display clock signal to display the loaded display data, the display position is not updated while no data to be transmitted is stored in the data transfer unit, and a display image shift can be prevented.

DESCRIPTION OF REFERENCE NUMERALS

Figure 1:
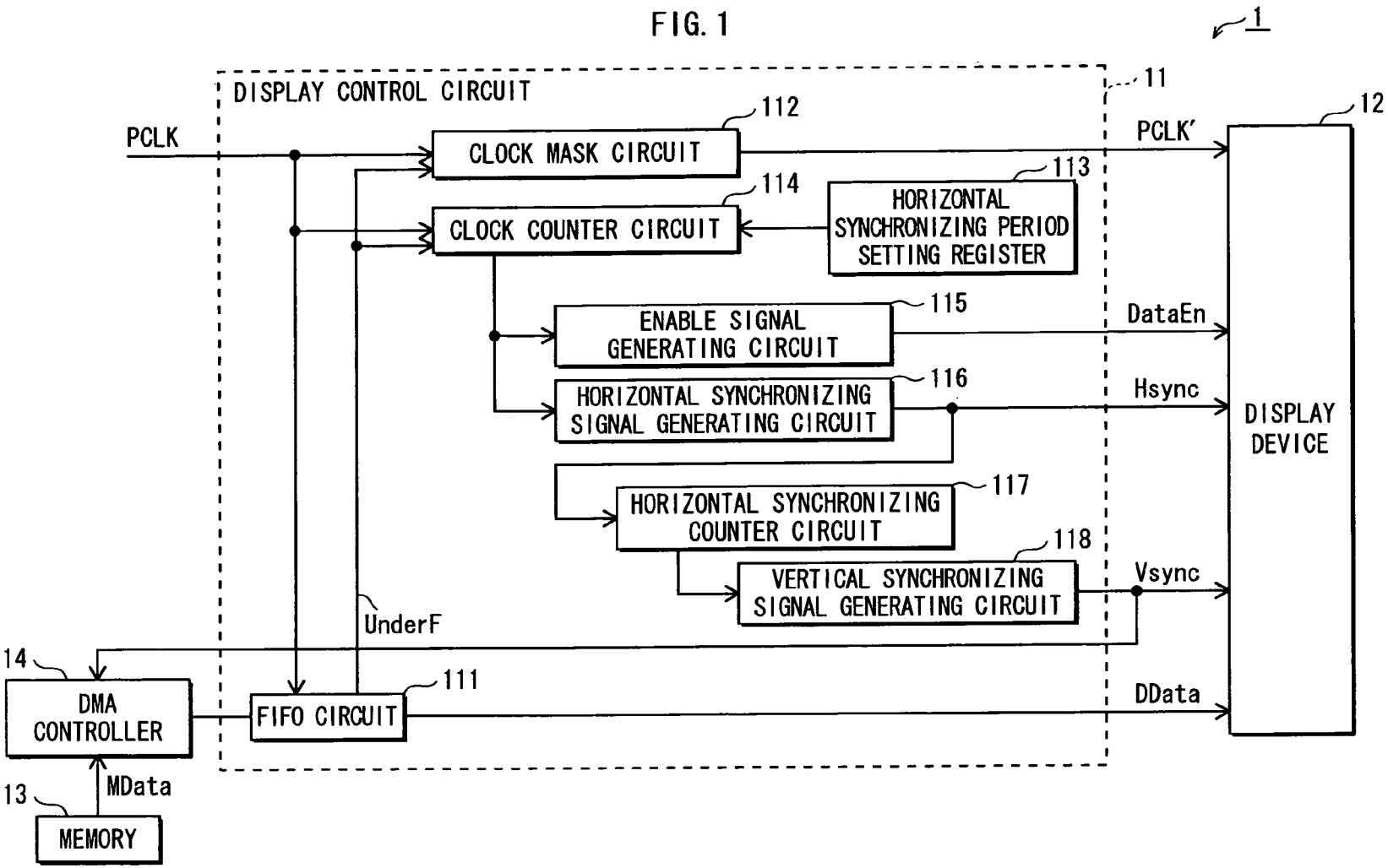
FIG. 1 is a block diagram showing a structure of a display system of a first embodiment.

1 display system
11 display control circuit
12 display device
13 memory
14 DMA controller
111 FIFO circuit
112 clock mask circuit
113 horizontal synchronizing period setting register
114 clock counter circuit
115 enable signal generating circuit
116 horizontal synchronizing signal generating circuit
117 horizontal synchronizing counter circuit
118 vertical synchronizing signal generating circuit

DETAILED DESCRIPTION OF THE INVENTION

First Embodiment

The following describes a first embodiment of the present invention, with reference to the attached drawings.

<Structure>

The following describes a structure of a display system of the first embodiment, with reference to FIG. 1. FIG. 1 is a block diagram showing the structure of the display system of the first embodiment.

A display system 1 includes a display control circuit 11, a display device 12, a memory 13, and a DMA controller 14. Note that the display control circuit 11 and display control circuits 21 and 31 which will be described later can be formed by one integrated circuit.

The display control circuit 11 includes a FIFO (first-in first-out) circuit 111, a clock mask circuit 112, a horizontal synchronizing period setting register 113, a clock counter circuit 114, an enable signal generating circuit 115, a horizontal synchronizing signal generating circuit 116, a horizontal synchronizing counter circuit 117, and a vertical synchronizing signal generating circuit 118.

To the FIFO circuit 111, memory data MData stored in the memory 13 is inputted from the DMA controller 14, and the FIFO circuit 111 stores the inputted memory data MData. To the FIFO circuit 111, a pixel clock (clock) PCLK is inputted from external, and the FIFO circuit 111 transmits data for one pixel to the display device 12 as display data DData in order of storage at a rising edge of the clock PCLK. The FIFO circuit 111 continues transmitting data inputted from the DMA controller 14 to the display device 12 until no data to be transmitted to the display device 12 is stored.

Also, the FIFO circuit 111 generates a notification signal UnderF to notify that there is no data to be transmitted to the display device 12 in the stored data, and transmits the generated notification signal UnderF to the clock mask circuit 112 and the clock counter circuit 114. Here, the state in which no data to be transmitted to the display device 12 is stored in the FIFO circuit 111 is referred to as underflow. The FIFO circuit 111 sets the notification signal UnderF at a high level during an underflow period, and sets the notification signal UnderF at a low level during a non-underflow period.

To the clock mask circuit 112, the clock PCLK is inputted from external, and the notification signal UnderF is inputted from the FIFO circuit 111. The clock mask circuit 112 transmits the inputted clock PCLK to the display device 12 as a display clock PCLK' when the notification signal UnderF is a low level. The clock mask circuit 112 masks the inputted clock PCLK when the notification signal UnderF is a high level, and transmits the display clock PCLK' whose level is kept high to the display device 12. In other words, the clock mask circuit 112 masks the clock PCLK while the FIFO circuit 111 is underflow, and transmits the display clock PCLK' whose level is kept high to the display device 12.

The horizontal synchronizing period setting register 113 is a register in which an upper limit of a count range of the clock counter circuit 114 (hereinafter, referred to as a horizontal synchronizing clock number) is set to be held, and transmits the held horizontal synchronizing clock number to the clock-counter circuit 114. Here, the horizontal synchronizing clock number held by the horizontal synchronizing period setting register 113 is "247".

To the clock counter circuit 114, the clock PCLK is inputted from external, the notification signal UnderF is inputted from the FIFO circuit 111, and the horizontal synchronizing clock number is inputted from the horizontal synchronizing period setting register 113. The clock counter circuit 114 transmits a counter value to the enable signal generating circuit 115 and the horizontal synchronizing signal generating circuit 116.

The clock counter circuit 114 counts up the counter value by 1 at a rising edge of the inputted clock PCLK when the notification signal UnderF is a low level. Also, the clock counter circuit 114 stops the count up operation when the notification signal UnderF is a high level. In other words, the clock counter circuit 114 performs the count up operation while the FIFO circuit 111 is not underflow, and stops the count up operation while the FIFO circuit 111 is underflow. The clock counter circuit 114 repeats counting from a counter value "0" to a counter value "horizontal synchronizing clock number".

To the enable signal generating circuit 115, the counter value (hereinafter, referred to as a pixel counter value) is inputted from the clock counter circuit 114. The enable signal generating circuit 115 generates a data enable signal DataEn based on the pixel counter value, and transmits the generated data enable signal DataEn to the display device 12. The data enable signal DataEn is a signal indicating whether display data DData which is inputted to the display device 12 is valid.

Here, the enable signal generating circuit 115 sets the data enable signal DataEn at a high level indicating that display data DData is valid if the pixel counter value is in a range of a lower limit "5" to an upper limit "244" which have been determined in advance, and sets the data enable signal DataEn at a low level indicating that the display data DData is not valid if the pixel counter value is other value out of the range.

To the horizontal synchronizing signal generating circuit 116, the pixel counter value is inputted from the clock counter circuit 114. The horizontal synchronizing signal generating circuit 116 generates a horizontal synchronizing signal Hsync based on the pixel counter value, and transmits the generated horizontal synchronizing signal Hsync to the display device 12 and the horizontal synchronizing counter circuit 117.

Here, the horizontal synchronizing signal generating circuit 116 sets the horizontal synchronizing signal Hsync at a low level if the pixel counter value is in a range of a lower limit "0" to an upper limit "1" which have been determined in advance, and sets the horizontal synchronizing signal Hsync at a high level if the pixel counter value is other value out of the range. A timing at which the horizontal synchronizing signal Hsync varies from the high level to the low level is a start timing of displaying 1 line.

To the horizontal synchronizing counter circuit 117, the horizontal synchronizing signal Hsync is inputted from the horizontal synchronizing signal generating circuit 116. The horizontal synchronizing counter circuit 117 internally holds an upper limit of a count range (hereinafter, referred to as a vertical synchronizing pulse number) which has been set in advance. The horizontal synchronizing counter circuit 117 counts up a counter value by 1 at a rising edge of the horizontal synchronizing signal Hsync, and transmits the counter value to the vertical synchronizing signal generating circuit 118. The horizontal synchronizing counter circuit 117 repeats counting from a counter value "0" to a counter value "vertical synchronizing pulse number".

To the vertical synchronizing signal generating circuit 118, the counter value (hereinafter, referred to as a synchronizing counter value) is inputted from the horizontal synchronizing counter circuit 117. The vertical synchronizing signal generating circuit 118 generates a vertical synchronizing signal Vsync based on the synchronizing counter value, and transmits the generated vertical synchronizing signal Vsync to the display device 12 and the DMA controller 14.

Here, the vertical synchronizing signal generating circuit 118 sets the vertical synchronizing signal Vsync at a low level if the synchronizing counter value is in a range of a lower limit "0" to an upper limit "1" which have been determined in advance, and sets the vertical synchronizing signal Vsync at a high level if the synchronizing counter value is other value out of the range. A timing at which the vertical synchronizing signal Vsync varies from the high level to the low level is a start timing of displaying 1 frame.

To the display device 12, the display data DData is inputted from the FIFO circuit 111, the display clock PCLK' is inputted from the clock mask circuit 112, and the data enable signal DataEn is inputted from the enable signal generating circuit 115. Also, to the display device 12, the horizontal synchronizing signal Hsync is inputted from the horizontal synchronizing signal generating circuit 116, and the vertical synchronizing signal Vsync is inputted from the vertical synchronizing signal generating circuit 118.

The display device 12 sequentially loads the display data DData at a rising edge of the display clock PCLK' while the data enable signal DataEn is a high level, and displays the loaded display data DData in a display. Also, the display device 12 transfers to a next line displaying at a falling edge of the horizontal synchronizing signal Hsync, and transfers to a next frame displaying at a falling edge of the vertical synchronizing signal Vsync.

The memory 13 is a storage device for storing data displayed in the display device 12, and has a structure in which two memory areas are provided to store data for one frame. Note that there is a case in which the memory 13 is accessed by a CPU, a CG, and the like (not illustrated) other than the DMA controller.

The DMA controller 14 performs a reading operation of data from the memory 13 without via a CPU. The DMA controller 14 reads memory data MData from the memory 13, and transfers the read memory data MData to the FIFO circuit 111. Note that the DMA controller 14 switches a memory area for reading the memory data MData from the memory 13 at a falling edge of the vertical synchronizing signal Vsync which is inputted from the vertical synchronizing signal generating circuit 118.

<Operation>

(Operations of DMA Controller and FIFO Circuit)

Figure 2:
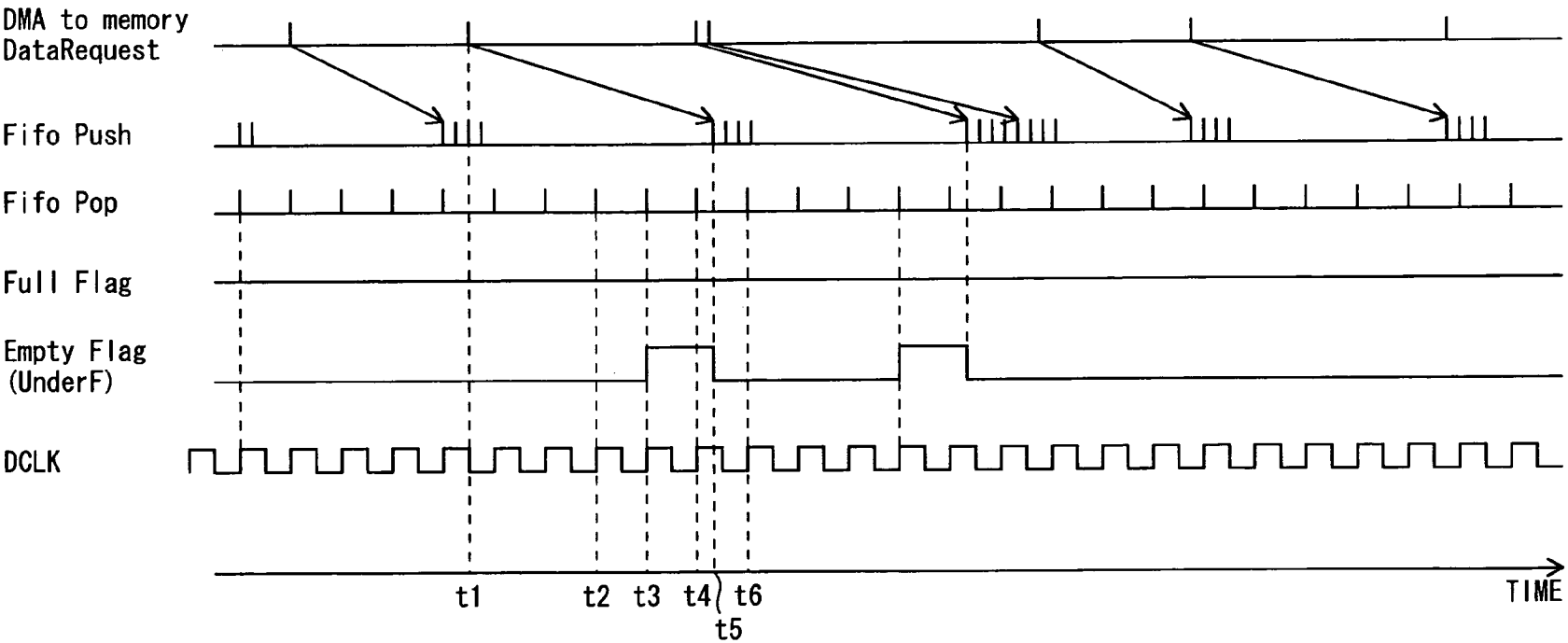
FIG. 2 is a timing chart showing an operation of the display system in FIG. 1.

The following describes operations of the DMA controller 14 and the FIFO circuit 111 with reference to FIG. 2. FIG. 2 is a timing chart showing the operations of the DMA controller 14 and the FIFO circuit 111. Note that in the timing chart in FIG. 2, a full flag of the FIFO circuit 111 is a low level indicating non-overflow for whole period.

The DMA controller 14 requests the memory 13 to transmit the memory data MData at a time t1.

The FIFO circuit 111 transmits the memory data MData to the display device 12 as the display data DData at a rising edge of the clock PCLK at a time t2 (Fifo Pop).

The FIFO circuit 111 transmits the memory data MData to the display device 12 as the display data DData at a rising edge of the clock PCLK at a time t3 (Fifo Pop). Suppose that the FIFO circuit 111 becomes underflow. The FIFO circuit 111 sets on an empty flag, i.e. raises the notification signal UnderF to a high level. The display data DData which is transmitted from the FIFO circuit 111 to the display device 12 at a rising edge of the clock PCLK at a time t4 is the display data DData which is transmitted to the display device 12 at the time t3.

According to the transmission request from the DMA controller 14 at the time t1, the memory data MData stored in the memory 13 is stored in the FIFO circuit 111 via the DMA controller 14 at a time t5 (Fifo Push). As a result, the FIFO circuit 111 becomes not underflow. Therefore, the FIFO circuit 111 sets off the empty flag, i.e. lowers the notification signal UnderF to a low level.

The FIFO circuit 111 transmits the memory data MData to the display device 12 as the display data DData at a rising edge of the clock PCLK at a time t6 (Fifo Pop).

(Operation of Display Control Circuit)

Figure 3:
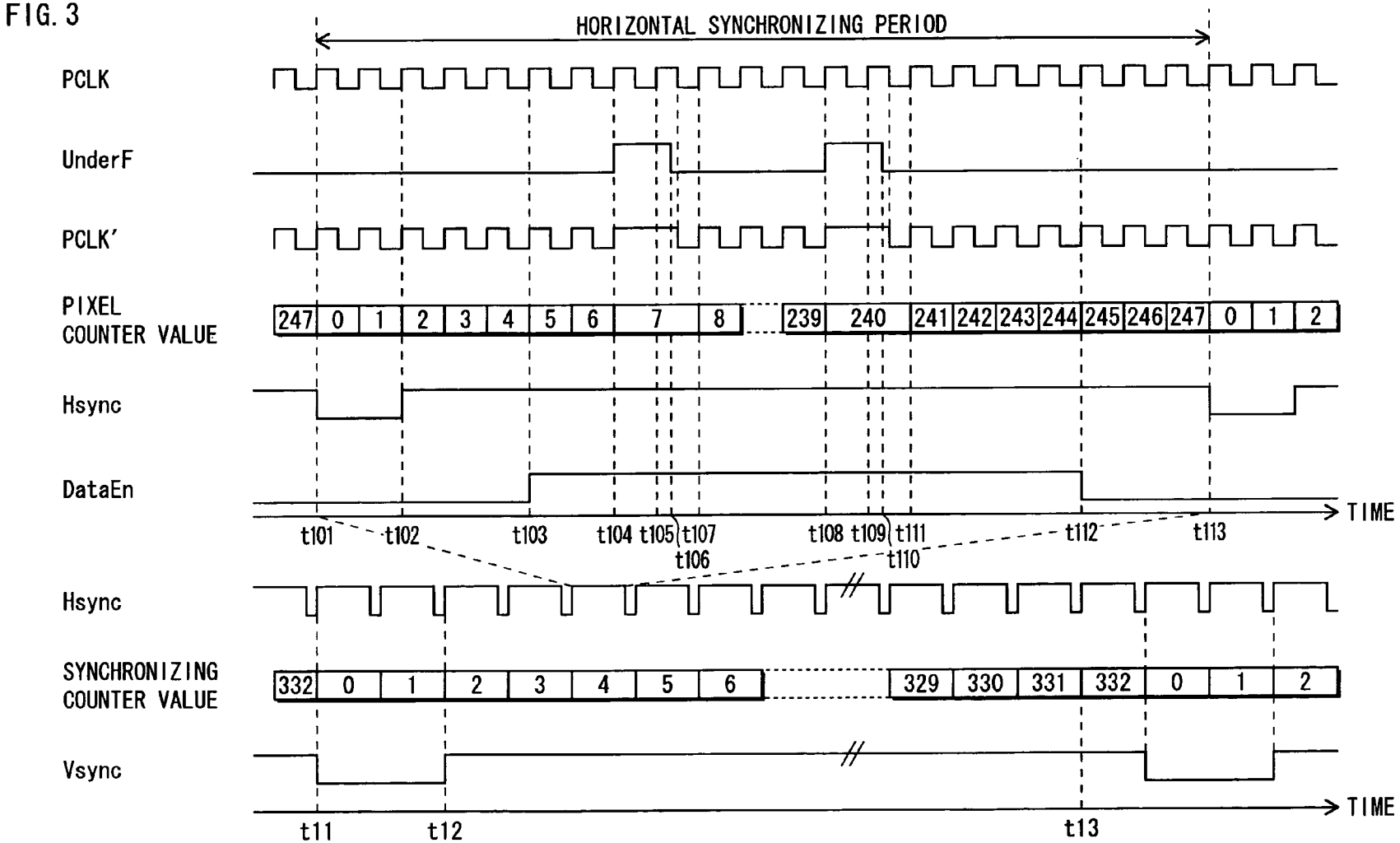
FIG. 3 is a timing chart showing an operation of the display system in FIG. 1.

The following describes an operation of the display control circuit 11 in the display system 1 in FIG. 1 with reference to FIG. 3. FIG. 3 is a timing chart showing the operation of the display control circuit 11.

Since the notification signal UnderF is a low level for a period from a time t101 to a time t104, the clock mask circuit 112 transmits the inputted clock PCLK to the display device 12 as the display clock PCLK'. Also, since the notification signal UnderF is a low level, the clock counter circuit 114 counts up a counter value by 1 at a rising edge of the inputted clock PCLK ("247"→"0"→"1"→ . . . →"7").

When the pixel counter value becomes "0" because the clock counter circuit 114 counts up the counter value at the time t101, the horizontal synchronizing signal generating circuit 116 lowers the horizontal synchronizing signal Hsync to a low level. When the pixel counter value becomes "2" because the clock counter circuit 114 counts up the counter value at the time t102, the horizontal synchronizing signal generating circuit 116 raises the horizontal synchronizing signal Hsync to a high level.

When the pixel counter value becomes "5" because the clock counter circuit 114 counts up the counter value at the time t103, the enable signal generating circuit 115 raises the data enable signal DataEn to a high level.

Suppose that the FIFO circuit 111 becomes underflow because the FIFO circuit 111 transmits the memory data MData to the display device 12 at the time t104. As a result, the FIFO circuit 111 raises the notification signal UnderF to a high level. Because of this, the clock mask circuit 112 masks the inputted clock PCLK, and transmits the display clock PCLK' whose level is kept high to the display device 12.

Since the notification signal UnderF is a high level at a time t105, the clock counter circuit 114 does not count up the counter value.

When the memory data MData is stored in the FIFO circuit 111 from the memory 13 via the DMA controller 14 at a time t106, the FIFO circuit 111 becomes not underflow. Therefore, the FIFO circuit 111 lowers the notification signal UnderF to a low level. As a result, the clock mask circuit 112 transmits the inputted clock PCLK to the display device 12 as the display clock PCLK'.

Since the notification signal UnderF is a low level for a period from a time t107 to a time t108, the clock mask circuit 112 transmits the inputted clock PCLK to the display device 12 as the display clock PCLK'. Also, since the notification signal UnderF is a low level, the clock counter circuit 114 counts up the counter value by 1 at a rising edge of the inputted clock PCLK ("7"→"8"→ . . . →"240").

Suppose that the FIFO circuit 111 becomes underflow because the FIFO circuit 111 transmits the memory data MData to the display device 12 at the time t108. As a result, the FIFO circuit 111 raises the notification signal UnderF to a high level. Because of this, the clock mask circuit 112 masks the inputted clock PCLK, and transmits the display clock PCLK' whose level is kept high to the display device 12.

Since the notification signal UnderF is a high level at a time t109, the clock counter circuit 114 does not count up the counter value.

When the memory data MData is stored in the FIFO circuit 111 from the memory 13 via the DMA controller 14 at a time t110, the FIFO circuit 111 becomes not underflow. Therefore, the FIFO circuit 111 lowers the notification signal UnderF to a low level. As a result, the clock mask circuit 112 transmits the inputted clock PCLK to the display device 12 as the display clock PCLK'.

Since the notification signal UnderF is a low level for a period from a time t111 to a time t113, the clock mask circuit 112 transmits the inputted clock PCLK to the display device 12 as the display clock PCLK'. Also, since the notification signal UnderF is a low level, the clock counter circuit 114 counts up the counter value by 1 at a rising edge of the inputted clock PCLK ("240"→"241"→ . . . →"247"→"0").

When the pixel counter value becomes "245" because the clock counter circuit 114 counts up the counter value at the time t112, the enable signal generating circuit 115 lowers the data enable signal DataEn to a low level.

When the pixel counter value becomes "0" because the clock counter circuit 114 counts up the counter value at the time t113, the horizontal synchronizing signal generating circuit 116 lowers the horizontal synchronizing signal Hsync to a low level.

The horizontal synchronizing counter circuit 117 counts up the counter value by 1 at a rising edge of the horizontal synchronizing signal Hsync for the period from a time t11 to a time t13 ("332"→"0"→"1" . . . →"332"). When a synchronizing counter value becomes "0" because the horizontal synchronizing counter circuit 117 counts up the counter value at the time t11, the vertical synchronizing signal generating circuit 118 lowers the vertical synchronizing signal Vsync to a low level. Then, when the synchronizing counter value becomes "2" because the horizontal synchronizing counter circuit 117 counts up the counter value at the time t12, the vertical synchronizing signal generating circuit 118 raises the vertical synchronizing signal Vsync to a high level.

<Effect>

In the display system 1 of the above-mentioned first embodiment, the clock mask circuit 112 masks the clock PCLK while the FIFO circuit 111 is underflow, and transmits the display clock PCLK' whose level is kept high to the display device 12. Because of this, there is no rising edge in the display clock PCLK' while the FIFO circuit 111 is underflow. Therefore, in the display device 12, a pixel position which displays the display data DData does not shift to the next pixel position while the FIFO circuit 111 is underflow. As a result, even if underflow occurs in the FIFO circuit 111, the display data DData is displayed at a pixel position at which the display data DData is to be originally displayed.

Also, while underflow occurs in the FIFO circuit 111 and the clock mask circuit 112 masks the clock PCLK, the clock counter circuit 114 stops the count up operation of the clock PCLK. Therefore, even if the FIFO circuit 111 is underflow while a line in a display is being displayed, the displaying does not shift to the next line displaying before displaying of the line is completed.

Second Embodiment

The following describes a second embodiment of the present invention, with reference to the attached drawings. Here, the second embodiment is made by adding the following structure to the first embodiment. The structure maintains a horizontal synchronizing period even if underflow occurs in the FIFO circuit. Note that in the second embodiment, the same symbols as in the first embodiment are assigned to the component parts having the same functions, and the explanations thereof are omitted because the explanation of the first embodiment can be applied to the second embodiment.

<Structure>

Figure 4:
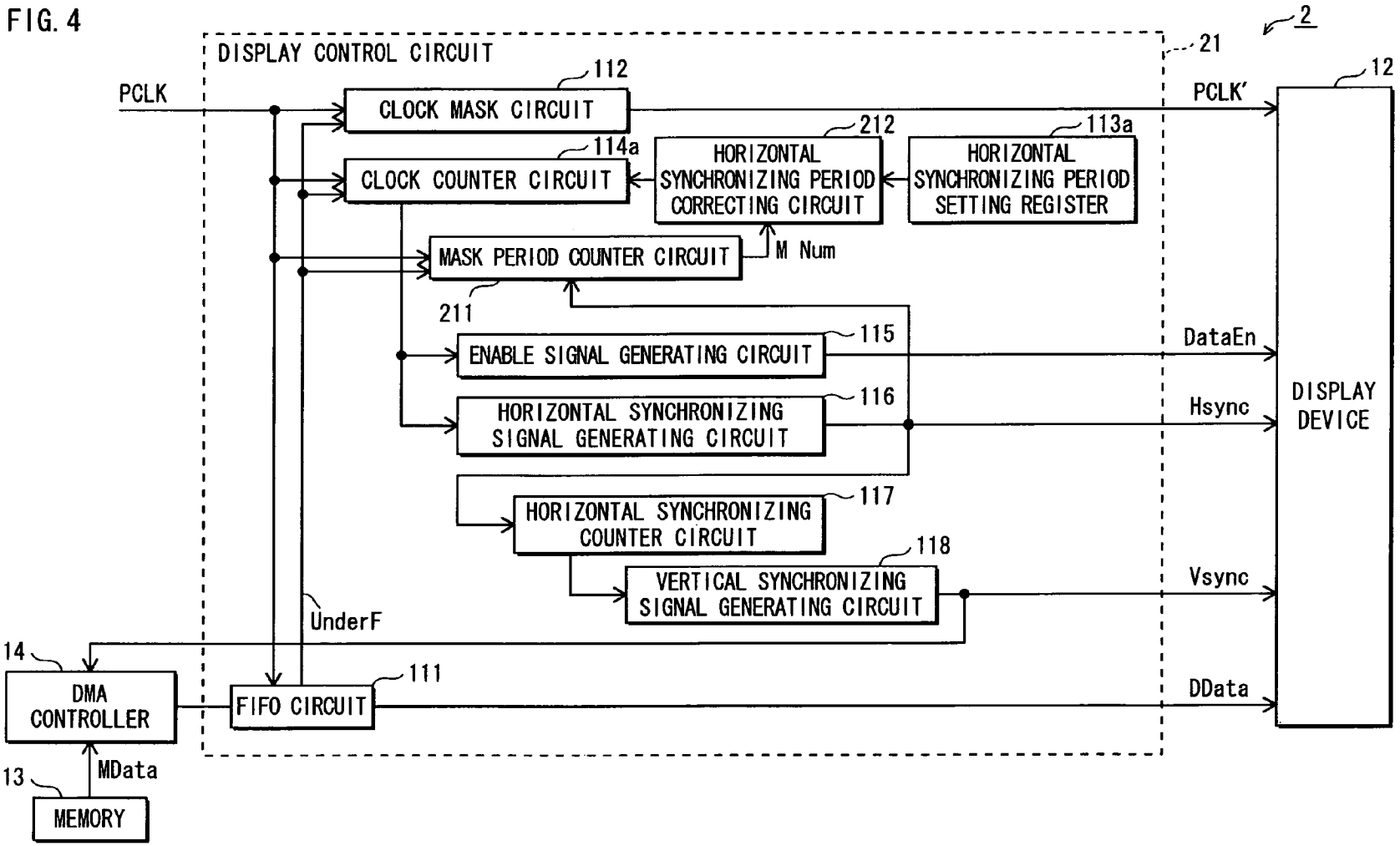
FIG. 4 is a block diagram showing a structure of a display system of a second embodiment.

The following describes a structure of a display system of the second embodiment, with reference to FIG. 4. FIG. 4 is a block diagram showing the structure of the display system of the second embodiment.

A display system 2 includes the display control circuit 21, the display device 12, the memory 13, and the DMA controller 14.

The display control circuit 21 includes the FIFO circuit 111, the clock mask circuit 112, a horizontal synchronizing period setting register 113*a*, a mask period counter circuit 211, a horizontal synchronizing period correcting circuit. 212, a clock counter circuit 114*a*, the enable signal generating circuit 115, the horizontal synchronizing signal generating circuit 116, the horizontal synchronizing counter circuit 117, and the vertical synchronizing signal generating circuit 118.

Note that the FIFO circuit 111 transmits the notification signal UnderF to the clock mask circuit 112 and the clock counter circuit 114 in the first embodiment. On the other hand, the FIFO circuit 111 transmits the notification signal UnderF to the clock mask circuit 112, the clock counter circuit 114*a*, and the mask period counter circuit 211 in the second embodiment. The horizontal synchronizing signal generating circuit 116 transmits the horizontal synchronizing signal Hsync to the display device 12 and the horizontal synchronizing counter circuit 117 in the first embodiment. On the other hand, the horizontal synchronizing signal generating circuit 116 transmits the horizontal synchronizing signal Hsync to the display device 12, the horizontal synchronizing counter circuit 117, and the mask period counter circuit 211 in the second embodiment.

The horizontal synchronizing period setting register 113*a* is a register in which an upper limit of a count range of the clock counter circuit 114*a* (horizontal synchronizing clock number) is set to be held, and transmits the held horizontal synchronizing clock number to the horizontal synchronizing period correcting circuit 212. Here, the horizontal synchronizing clock number held by the horizontal synchronizing period setting register 113*a* is "247". To the mask period counter circuit 211, the clock PCLK is inputted from external, the notification signal UnderF is inputted from the FIFO circuit 111, and the horizontal synchronizing signal Hsync is inputted from the horizontal synchronizing signal generating circuit 116.

The mask period counter circuit 211 brings a counter value back to "0" at a falling edge of the horizontal synchronizing signal Hsync. The mask period counter circuit 211 counts up the counter value by 1 at a rising edge of the inputted clock PCLK when the notification signal UnderF is a high level. Also, the mask period counter circuit 211 stops the count up operation when the notification signal UnderF is a low level. In other words, the mask period counter circuit 211 counts the rising edge of the clock PCLK when the FIFO circuit 111 is underflow while 1 line is being displayed.

To the horizontal synchronizing period correcting circuit 212, the horizontal synchronizing clock number is inputted from the horizontal synchronizing period setting register 113*a*, and the counter value (hereinafter, referred to as a mask clock number MNum) is inputted from the mask period counter circuit 211. The horizontal synchronizing period correcting circuit 212 subtracts the mask clock number MNum from the horizontal synchronizing clock number, and transmits the subtracted value to the clock counter circuit 114*a*.

To the clock counter circuit 114*a*, the clock PCLK is inputted from external, the notification signal UnderF is inputted from the FIFO circuit 111, and the subtracted value (hereinafter, referred to as a correction horizontal synchronizing clock number) is inputted from the horizontal synchronizing period correcting circuit 212. Note that the correction horizontal synchronizing clock number is updated as needed if underflow occurs in the FIFO circuit 111. The clock counter circuit 114*a* transmits the counter value (pixel counter value) to the enable signal generating circuit 115 and the horizontal synchronizing signal generating circuit 116.

The clock counter circuit 114*a* counts up the counter value by 1 at a rising edge of the inputted clock PCLK when the notification signal UnderF is a low level. Also, the clock counter circuit 114*a* stops the count up operation when the notification signal UnderF is a high level. In other words, the clock counter circuit 114*a* performs the count up operation while the FIFO circuit 111 is not underflow, and stops the count up operation while the FIFO circuit 111 is underflow. The clock counter circuit 114*a* repeats counting from a counter value "0" to a counter value "correction horizontal synchronizing clock number".

<Operation>

Figure 5:
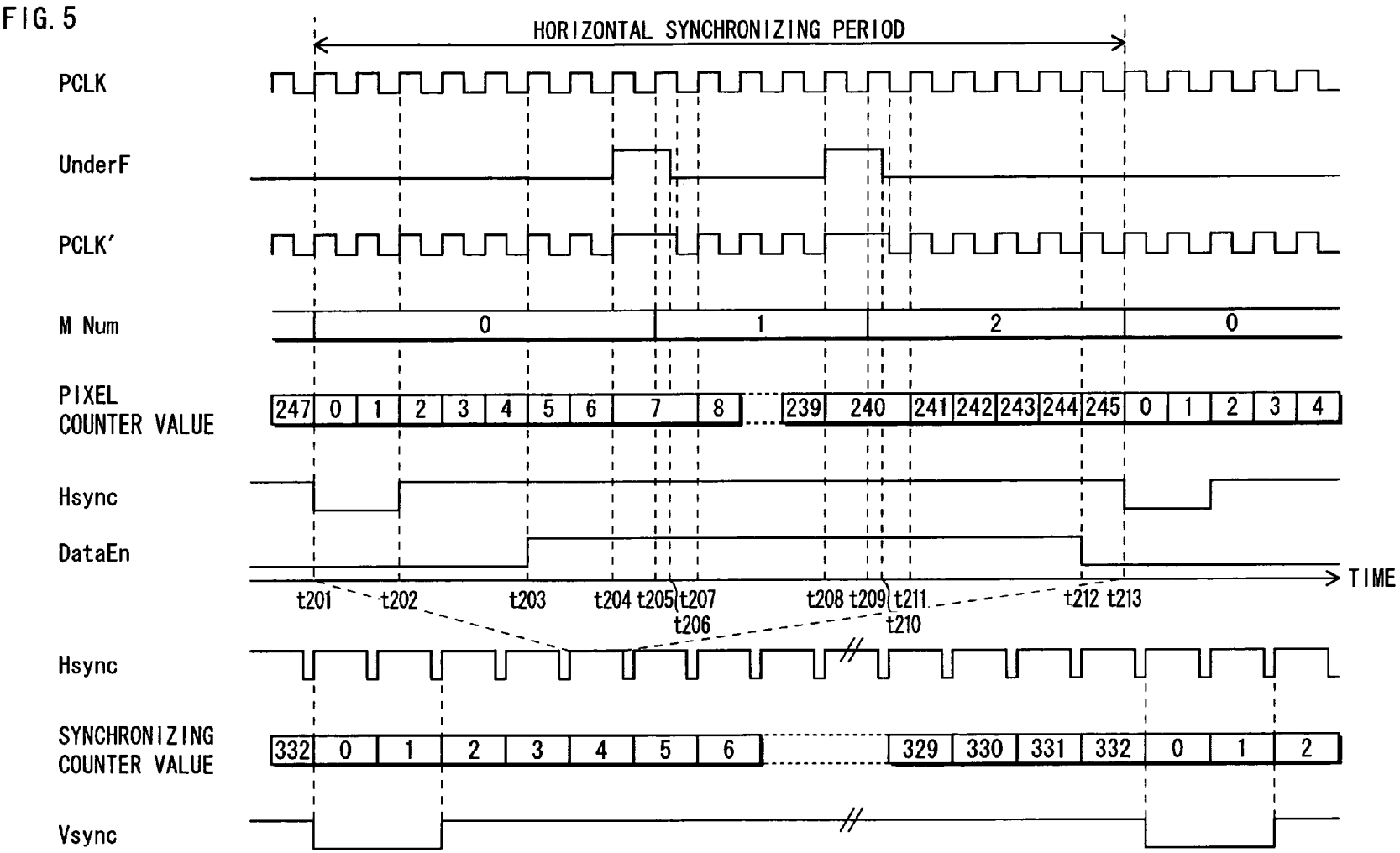
FIG. 5 is a timing chart showing an operation of the display system in FIG. 4.

The following describes an operation of the display control circuit 21 of the display system 2 in FIG. 4 with reference to FIG. 5. FIG. 5 is a timing chart showing the operation of the display control circuit 21. Note that the operation of generating the vertical synchronizing signal Vsync based on the horizontal synchronizing signal Hsync is the same as in the first embodiment, and the explanation thereof in the first embodiment can be applied to the second embodiment. Therefore, the explanation is omitted.

Since the notification signal UnderF is a low level for a period from a time t201 to a time t204, the clock mask circuit 112 transmits the inputted clock PCLK to the display device 12 as the display clock PCLK'. Also, since the notification signal UnderF is a low level, the clock counter circuit 114*a* counts up a counter value by 1 at a rising edge of the inputted clock PCLK ("247"→"0"→"1"→ . . . →"7").

When the pixel counter value becomes "0" because the clock counter circuit 114*a* counts up the counter value at the time t201, the horizontal synchronizing signal generating circuit 116 lowers the horizontal synchronizing signal Hsync to a low level. At this time, the mask period counter circuit 211 brings the counter value (mask clock number MNum) back to "0" at a falling edge of the horizontal synchronizing signal Hsync, in order to count the clock number of the clock PCLK while the FIFO circuit 111 is underflow in a line to be displayed. The horizontal synchronizing period correcting circuit 212 subtracts the mask clock number MNum "0" from the horizontal synchronizing clock number "247" which is held by the horizontal synchronizing period setting register 113*a*, and transmits the correction horizontal synchronizing clock number "247" to the clock counter circuit 114*a*.

When the pixel counter value becomes "2" because the clock counter circuit 114*a* counts up the counter value at the time t202, the horizontal synchronizing signal generating circuit 116 raises the horizontal synchronizing signal Hsync to a high level.

When the pixel counter value becomes "5" because the clock counter circuit 114*a* counts up the counter value at the time t203, the enable signal generating circuit 115 raises the data enable signal DataEn to a high level.

Suppose that the FIFO circuit 111 becomes underflow because the FIFO circuit 111 transmits the memory data MData to the display device 12 at the time t204. As a result, the FIFO circuit 111 raises the notification signal UnderF to a high level. Because of this, the clock mask circuit 112 masks the inputted clock PCLK, and transmits the display clock PCLK' whose level is kept high to the display device 12.

Since the notification signal UnderF is a high level at a time t205, the clock counter circuit 114*a* does not count up the counter value.

The mask period counter circuit 211 counts up the counter value (mask clock number MNum) by 1 at a rising edge of the clock PCLK because the notification signal UnderF is a high level ("0"→"1"). The horizontal synchronizing period correcting circuit 212 subtracts the mask clock number MNum "1" from the horizontal synchronizing clock number "247", and transmits the correction horizontal synchronizing clock number "246" to the clock counter circuit 114*a*. Because of this, an upper limit of a count range of the clock counter circuit 114*a* is updated to "246".

When the memory data MData is stored in the FIFO circuit 111 from the memory 13 via the DMA controller 14 at a time t206, the FIFO circuit 111 becomes not underflow. Therefore, the FIFO circuit 111 lowers the notification signal UnderF to a low level. As a result, the clock mask circuit 112 transmits the inputted clock PCLK to the display device 12 as the display clock PCLK'.

Since the notification signal UnderF is a low level for a period from a time t207 to a time t208, the clock mask circuit 112 transmits the inputted clock PCLK to the display device 12 as the display clock PCLK'. Also, since the notification signal UnderF is a low level, the clock counter circuit 114*a* counts up the counter value by 1 at a rising edge of the inputted clock PCLK ("7"→"8"→ . . . →"240").

Suppose that the FIFO circuit 111 becomes underflow because the FIFO circuit 111 transmits the memory data MData to the display device 12 at the time t208. As a result, the FIFO circuit 111 raises the notification signal UnderF to a high level. Because of this, the clock mask circuit 112 masks the inputted clock PCLK, and transmits the display clock PCLK' whose level is kept high to the display device 12.

Since the notification signal UnderF is a high level at a time t209, the clock counter circuit 114*a* does not count up the counter value.

The mask period counter circuit 211 counts up the counter value (mask clock number MNum) by 1 at a rising edge of the clock PCLK because the notification signal UnderF is a high level ("1"→"2"). The horizontal synchronizing period correcting circuit 212 subtracts the mask clock number MNum "2" from the horizontal synchronizing clock number "247", and transmits the correction horizontal synchronizing clock number "245" to the clock counter circuit 114*a*. Because of this, the upper limit of the count range of the clock counter circuit 114*a* is updated to "245".

When the memory data MData is stored in the FIFO circuit 111 from the memory 13 via the DMA controller 14 at a time t210, the FIFO circuit 111 becomes not underflow. Therefore, the FIFO circuit 111 lowers the notification signal UnderF to a low level. As a result, the clock mask circuit 112 transmits the inputted clock PCLK to the display device 12 as the display clock PCLK'.

Since the notification signal UnderF is a low level for a period from a time t211 to a time t213, the clock mask circuit 112 transmits the inputted clock PCLK to the display device 12 as the display clock PCLK'. Also, since the notification signal UnderF is a low level, the clock counter circuit 114*a* counts up the counter value by 1 at a rising edge of the inputted clock PCLK ("240"→"241"→ . . . →"245"→"0"). Here, since the upper limit of the count range of the clock counter circuit 114*a* is "245" because of the process performed by the horizontal synchronizing period correcting circuit 212, the count value of the clock counter circuit 114*a* becomes "0" from "245".

When the pixel counter value becomes "245" because the clock counter circuit 114*a* counts up the counter value at the time t212, the enable signal generating circuit 115 lowers the data enable signal DataEn to a low level.

<Effect>

In the display system 2 of the above-mentioned second embodiment, same as in the display system 1 of the first embodiment, a display shift of a display image can be prevented even if underflow occurs in the FIFO circuit 111.

Also, if underflow occurs in the FIFO circuit 111, the clock counter circuit 114*a* stops the count up operation. However, the mask period counter circuit 211 counts the edge number of a rising edge of the clock PCLK for the period in which the count up operation stops, and the upper limit of the count range of the clock counter circuit 114*a* is corrected so as to be smaller by the count value. Therefore, a horizontal synchronizing period can be kept constant even if underflow occurs in the FIFO circuit 111.

Third Embodiment

The following describes a third embodiment of the present invention, with reference to the attached drawings. However, in the first embodiment, if the FIFO circuit is underflow, the clock PCLK is necessarily masked. On the other hand, in the third embodiment, if the FIFO circuit is underflow, one operation mode can be selected from the following two operation modes. One is an operation mode for masking the clock PCLK (hereinafter, referred to as a mask processing mode), and the other is an operation mode for not masking the clock PCLK (hereinafter, referred to as a non-mask processing mode). Note that in the third embodiment, the same symbols as in the first embodiment are assigned to the component parts having the same functions, and the explanations thereof are omitted because the explanation of the first embodiment can be applied to the third embodiment.

<Structure>

Figure 6:
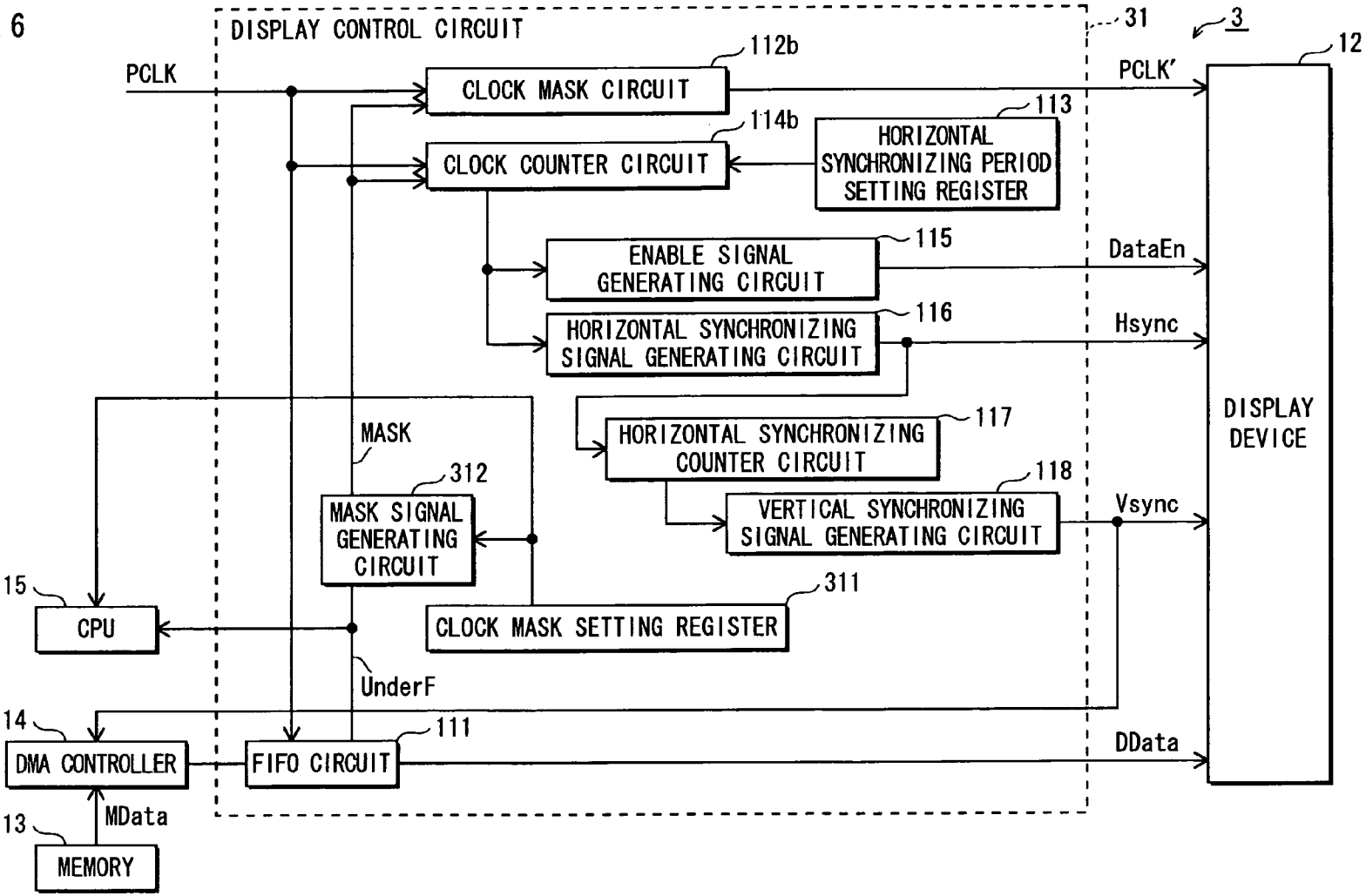
FIG. 6 is a block diagram showing a structure of a display system of a third embodiment.

The following describes a structure of a display system of the third embodiment, with reference to FIG. 6. FIG. 6 is a block diagram showing the structure of the display system of the third embodiment.

A display system 3 includes the display control circuit 31, the display device 12, the memory 13, the DMA controller 14, and a CPU 15.

The display control circuit 31 includes the FIFO circuit 111, a clock mask setting register 311, a mask signal generating circuit 312, a clock mask circuit 112*b*, the horizontal synchronizing period setting register 113, a clock counter circuit 114*b*, the enable signal generating circuit 115, the horizontal synchronizing signal generating circuit 116, the horizontal synchronizing counter circuit 117, and the vertical synchronizing signal generating circuit 118.

Note that the FIFO circuit 111 transmits the notification signal Under F to the clock mask circuit 112 and the clock counter circuit 114 in the first embodiment. On the other hand, the FIFO circuit 111 transmits the notification signal UnderF to the mask signal generating circuit 312 and the CPU 15 in the third embodiment. Also, the horizontal synchronizing period setting register 113 transmits the horizontal synchronizing clock number to the clock counter circuit 114 in the first embodiment. On the other hand, the horizontal synchronizing period setting register 113 transmits the horizontal synchronizing clock number to the clock counter circuit 114*b* in the third embodiment.

The clock mask setting register 311 is a register for setting one of the operation modes of the mask processing mode and the non-mask processing mode to operate the whole display control circuit 31, based on an instruction from external. Also, the clock mask setting register 311 transmits a register value to the mask signal generating circuit 312 and the CPU 15. Here, the clock mask setting register 311 is composed of a counter bit of one bit. "1" is set as the register value in a case of the mask processing mode, and "0" is set as the register value in a case of the non-mask processing mode.

To the mask signal generating circuit 312, the register value is inputted from the clock mask setting register 311, and the notification signal UnderF is inputted from the FIFO circuit 111. The mask signal generating circuit 312 transmits the notification signal UnderF to the clock mask circuit 112*b* and the clock counter circuit 114*b* as a mask signal MASK when the register value is "1" (mask processing mode). Also, the mask signal generating circuit 312 masks the notification signal UnderF when the register value is "0" (non-mask processing mode), and transmits the mask signal MASK whose level is kept low to the clock mask circuit 112*b* and the clock counter circuit 114*b*.

To the clock mask circuit 112*b*, the clock PCLK is inputted from external, and the mask signal MASK is inputted from the mask signal generating circuit 312. The clock mask circuit 112*b* transmits the clock PCLK to the display device 12 as the display clock PCLK' when the mask signal MASK is a low level. The clock mask circuit 112*b* masks the inputted clock PCLK' when the mask signal MASK is a high level, and transmits the display clock PCLK' whose level is kept high to the display device 12. In other words, the clock mask circuit 112*b* masks the inputted clock PCLK while the FIFO circuit 11 is underflow in a case of the mask processing mode. Also, the clock mask circuit 112*b* transmits the inputted clock PCLK to the display device 12 as the display clock PCLK' regardless of whether the FIFO circuit 111 is underflow in a case of the non-mask processing mode.

To the clock counter circuit 114*b*, the clock PCLK is inputted from external, the mask signal MASK is inputted from the mask signal generating circuit 312, and the horizontal synchronizing clock number is inputted from the horizontal synchronizing period setting register 113. The clock counter circuit 114*b* transmits a counter value to the enable signal generating circuit 115 and the horizontal synchronizing signal generating circuit 116.

The clock counter circuit 114*b* counts up the counter value by 1 at a rising edge of the inputted clock PCLK when the mask signal MASK is a low level. Also, the clock counter circuit 114*b* stops the count up operation when the mask signal MASK is a high level. The clock counter circuit 114*b* repeats counting from a counter value "0" to a counter value "horizontal synchronizing clock number". In other words, the clock counter circuit 114*b* performs the count up operation only while the FIFO circuit 111 is not underflow in a case of the mask processing mode. Also, the clock counter circuit 114*b* performs the count up operation regardless of whether the FIFO circuit 111 is underflow in a case of the non-mask processing mode.

To the CPU 15, the register value is inputted from the clock mask setting register 311, and the notification signal UnderF is inputted from the FIFO circuit 111. When the inputted register value is "1" (mask processing mode), the CPU 15 does not perform an underflow error process for removing a factor of underflow, even if underflow occurs in the FIFO circuit 111. When the inputted register value is "0" (non-mask processing mode), the CPU 15 performs the underflow error process if the notification signal UnderF be comes a high level. Here, the following are the examples of the underflow error process. For example, the access priority of the DMA controller 14 to the memory 13 is increased, a created program of display data is changed to a lightly loaded created program, programs other than a display are stopped, and the like.

<Operation>

(Operation in Mask Processing Mode)

Figure 7:
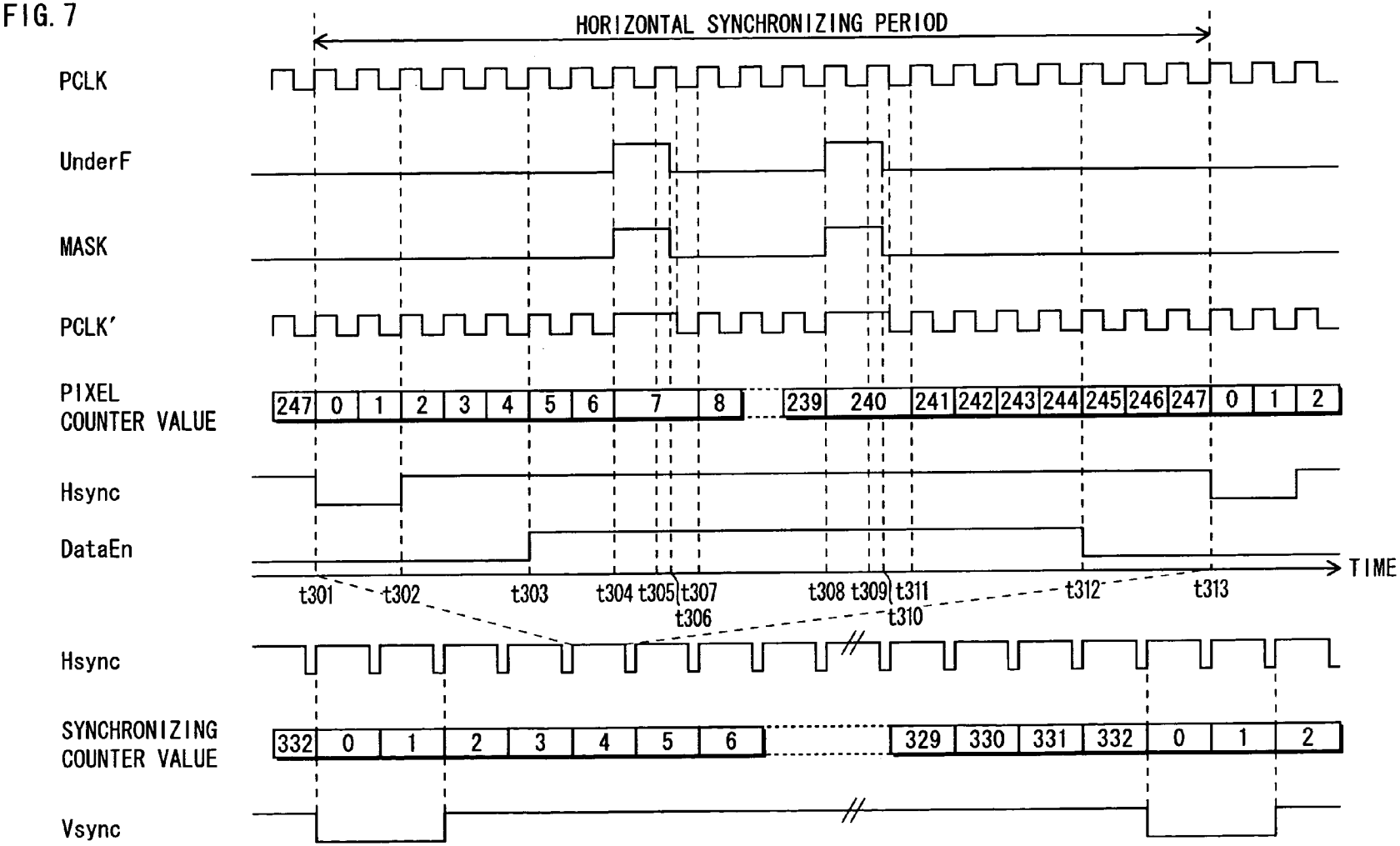
FIG. 7 is a timing chart showing an operation of the display system in FIG. 6.

The following describes an operation of the display control circuit 31 in the mask processing mode of the display system 3 in FIG. 6 with reference to FIG. 7. FIG. 7 is a timing chart showing the operation of the display control circuit 31 in the mask processing mode. Note that the operation of generating the vertical synchronizing signal Vsync based on the horizontal synchronizing signal Hsync is the same as in the first embodiment, and the explanation thereof in the first embodiment can be applied to the third embodiment. Therefore, the explanation is omitted.

However, in the clock mask setting register 311, "1" (mask processing mode) is set, and the mask signal generating circuit 312 transmits the notification signal UnderF to the clock mask circuit 112*b* and the clock counter circuit 114*b* as the mask signal MASK.

For a period from a time t301 to a time t304, the notification signal UnderF is a low level and the mask signal generating circuit 312 transmits the mask signal MASK whose level is low to the clock mask circuit 112*b* and the clock counter circuit 114*b*.

Since the inputted mask signal MASK is a low level, the clock mask circuit 112*b* transmits the inputted clock PCLK to the display device 12 as the display clock PCLK'. Also, since the mask signal MASK is a low level, the clock counter circuit 114*b* counts up a counter value by 1 at a rising edge of the inputted clock PCLK ("247"→"0"→"1"→ . . . →"7").

When a pixel counter value becomes "0" because the clock counter circuit 114*b* counts up the counter value at the time t301, the horizontal synchronizing signal generating circuit 116 lowers the horizontal synchronizing signal Hsync to a low level. When the pixel counter value becomes "2" because the clock counter circuit 114*b* counts up the counter value at the time t302, the horizontal synchronizing signal generating circuit 116 raises the horizontal synchronizing signal Hsync to a high level.

When the pixel counter value becomes "5" because the clock counter circuit 114*b* counts up the counter value at the time t303, the enable signal generating circuit 115 raises the data enable signal DataEn to a high level.

Suppose that the FIFO circuit 111 becomes underflow because the FIFO circuit 111 transmits the memory data MData to the display device 12 at the time t304. As a result, the FIFO circuit 111 raises the notification signal UnderF to a high level. The mask signal generating circuit 312 transmits the notification signal UnderF whose level is high to the clock mask circuit 112*b* and the clock counter circuit 114*b* as the mask signal MASK. At this time, although the notification signal UnderF whose level is high is inputted, the CPU 15 does not perform the underflow error process because the register value "1" (mask processing mode) is inputted from the clock mask setting register 311.

Since the mask signal MASK is a high level at a time t305, the clock counter circuit 114*b* does not count up the counter value.

When the memory data MData is stored in the FIFO circuit 111 from the memory 13 via the DMA controller 14 at a time t306, the FIFO circuit 111 becomes not underflow. Therefore, the FIFO circuit 111 lowers the notification signal UnderF to a low level. The mask signal generating circuit 312 transmits the notification signal UnderF whose level is low to the clock mask circuit 112*b* and the clock counter circuit 114*b* as the mask signal MASK.

For a period from a time t307 to a time t308, the notification signal UnderF is a low level and the mask signal generating circuit 312 transmits the mask signal MASK whose level is low to the clock mask circuit 112*b* and the clock counter circuit 114*b*.

Since the mask signal MASK is a low level, the clock mask circuit 112*b* transmits the inputted clock PCLK to the display device 12 as the display clock PCLK'. Also, since the mask signal MASK is a low level, the clock counter circuit 114*b* counts up the counter value by 1 at a rising edge of the inputted clock PCLK ("7"→"8"→ . . . →"240").

Suppose that the FIFO circuit 111 becomes underflow because the FIFO circuit 111 transmits the memory data MData to the display device 12 at the time t308. As a result, the FIFO circuit 111 raises the notification signal UnderF to a high level. The mask signal generating circuit 312 transmits the notification signal UnderF whose level is high to the clock mask circuit 112*b* and the clock counter circuit 114*b* as the mask signal MASK.

Since the mask signal MASK is a high level at a time t309, the clock counter circuit 114*b* does not count up the counter value.

When the memory data MData is stored in the FIFO circuit 111 from the memory 13 via the DMA controller 14 at a time t310, the FIFO circuit 111 becomes not underflow. Therefore, the FIFO circuit 111 lowers the notification signal UnderF to a low level. The mask signal generating circuit 312 transmits the notification signal UnderF whose level is low to the clock mask circuit 112*b* and the clock counter circuit 114*b* as the mask signal MASK.

For a period from a time t311 to a time t313, the notification signal UnderF is a low level and the mask signal generating circuit 312 transmits the mask signal MASK whose level is low to the clock mask circuit 112*b* and the clock counter circuit 114*b*.

Since the mask signal MASK is a low level, the clock mask circuit 112*b* transmits the inputted clock PCLK to the display device 12 as the display clock PCLK'. Also, since the mask signal MASK is a low level, the clock counter circuit 114*b* counts up the counter value by 1 at a rising edge of the inputted clock PCLK ("240"→"241"→ . . . →"247"→"0").

When the pixel counter value becomes "245" because the clock counter circuit 114*b* counts up the counter value at the time t312, the enable signal generating circuit 115 lowers the data enable signal DataEn to a low level.

When the pixel counter value becomes "0" because the clock counter circuit 114*b* counts up the counter value at the time t313, the horizontal synchronizing signal generating circuit 116 lowers the horizontal synchronizing signal Hsync to a low level.

(Operation in Non-Mask Processing Mode)

Figure 8:
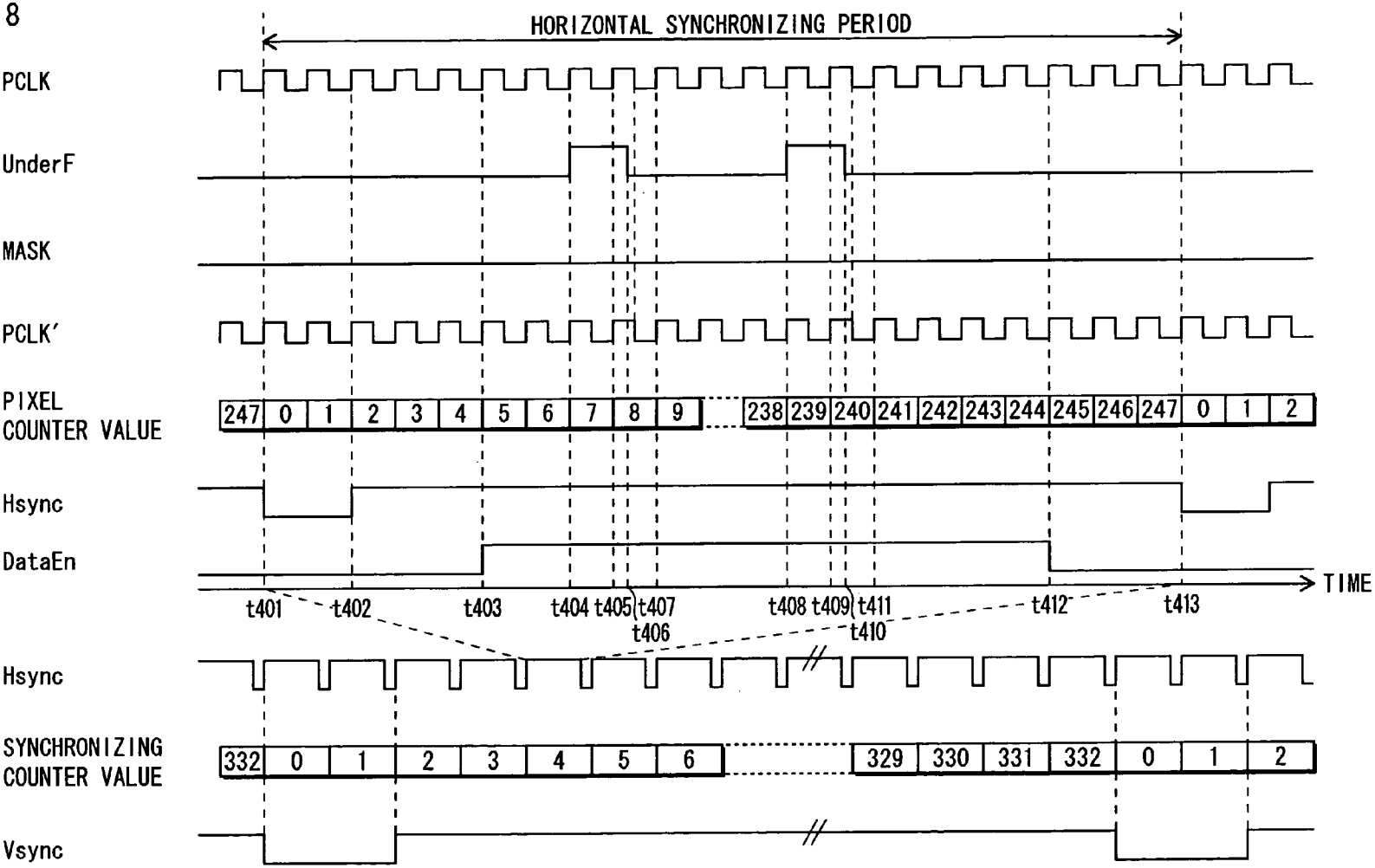
FIG. 8 is a timing chart showing an operation of the display system in FIG. 6.

The following describes an operation of the display control circuit 31 in the non-mask processing mode of the display system 3 in FIG. 6 with reference to FIG. 8. FIG. 8 is a timing chart showing the operation of the display control circuit 31 in the non-mask processing mode. Note that the operation of generating the vertical synchronizing signal Vsync based on the horizontal synchronizing signal Hsync is the same as in the first embodiment, and the explanation thereof in the first embodiment can be applied to the third embodiment. Therefore, the explanation is omitted.

However, in the clock mask setting register 311, "0" (non-mask processing mode) is set, the mask signal generating circuit 312 masks the notification signal UnderF, and transmits the mask signal MASK whose level is kept low to the clock mask circuit 112*b* and the clock counter circuit 114*b*.

For a period from a time t401 to a time t404, the mask signal generating circuit 312 masks the notification signal UnderF, and transmits the mask signal MASK whose level is low to the clock mask circuit 112*b* and the clock counter circuit 114*b*.

Since the inputted mask signal MASK is a low level, the clock mask circuit 112*b* transmits the inputted clock PCLK to the display device 12 as the display clock PCLK'. Also, since the mask signal MASK is a low level, the clock counter circuit 114*b* counts up a counter value by 1 at a rising edge of the inputted clock PCLK ("247"→"0"→"1"→ . . . →"7").

When a pixel counter value becomes "0" because the clock counter circuit 114*b* counts up the counter value at the time t401, the horizontal synchronizing signal generating circuit 116 lowers the horizontal synchronizing signal Hsync to a low level. When the pixel counter value becomes "2" because the clock counter circuit 114*b* counts up the counter value at the time t402, the horizontal synchronizing signal generating circuit 116 raises the horizontal synchronizing signal Hsync to a high level.

When the pixel counter value becomes "5" because the clock counter circuit 114*b* counts up the counter value at the time t403, the enable signal generating circuit 115 raises the data enable signal DataEn to a high level.

Suppose that the FIFO circuit 111 becomes underflow because the FIFO circuit 111 transmits the memory data MData to the display device 12 at the time t404. As a result, the FIFO circuit 111 raises the notification signal UnderF to a high level. Because the register value "0" (non-mask processing mode) is inputted to the mask signal generating circuit 312 from the clock mask setting register 311, the mask signal generating circuit 312 masks the notification signal UnderF, and transmits the mask signal MASK whose level is low to the clock mask circuit 112*b* and the clock counter circuit 114*b*. The FIFO circuit 111 is underflow, but the mask signal MASK is a low level. Therefore, the clock mask circuit 112*b* transmits the inputted clock PCLK to the display device 12 as the display clock PCLK'.

At this time, the CPU 15 performs the underflow error process because the notification signal UnderF whose level is high is inputted and the register value "0" (non-mask processing mode) is inputted from the clock mask setting register 311.

Since the mask signal MASK is a low level at a time t405, the clock counter circuit 114*b* counts up the counter value by 1 at a rising edge of the inputted clock PCLK ("7"→"8").

When the memory data MData is stored in the FIFO circuit 111 from the memory 13 via the DMA controller 14 at a time t406, the FIFO circuit 111 becomes not underflow. Therefore, the FIFO circuit 111 lowers the notification signal UnderF to a low level. The mask signal generating circuit 312 masks the notification signal UnderF, and transmits the mask signal MASK whose level is low to the clock mask circuit 112*b* and the clock counter circuit 114*b*.

For a period from a time t407 to a time t408, the mask signal generating circuit 312 masks the notification signal UnderF, and transmits the mask signal MASK whose level is low to the clock mask circuit 112*b* and the clock counter circuit 114*b*.

Since the mask signal MASK is a low level, the clock mask circuit 112*b* transmits the inputted clock PCLK to the display device 12 as the display clock PCLK'. Also, since the mask signal MASK is a low level, the clock counter circuit 114*b* counts up the counter value by 1 at a rising edge of the inputted clock PCLK ("8"→"9"→ . . . →"239").

Suppose that the FIFO circuit 111 becomes underflow because the FIFO circuit 111 transmits the memory data MData to the display device 12 at the time t408. As a result, the FIFO circuit 111 raises the notification signal UnderF to a high level. Because the register value "0" (non-mask processing mode) is inputted to the mask signal generating circuit 312 from the clock mask setting register 311, the mask signal generating circuit 312 masks the notification signal UnderF, and transmits the mask signal MASK whose level is low to the clock mask circuit 112*b* and the clock counter circuit 114*b*. The FIFO circuit 111 is underflow, but the mask signal MASK is a low level. Therefore, the clock mask circuit 112*b* transmits the inputted clock PCLK to the display device 12 as the display clock PCLK'.

Since the mask signal MASK is a low level at a time t409, the clock counter circuit 114*b* counts up the counter value by 1 at a rising edge of the inputted clock PCLK ("239"→"240"). When the memory data MData is stored in the FIFO circuit 111 from the memory 13 via the DMA controller 14 at a time t410, the FIFO circuit 111 becomes not underflow. Therefore, the FIFO circuit 111 lowers the notification signal UnderF to a low level. The mask signal generating circuit 312 masks the notification signal UnderF, and transmits the mask signal MASK whose level is low to the clock mask circuit 112*b* and the clock counter circuit 114*b*.

For a period from a time t411 to a time t413, the mask signal generating circuit 312 masks the notification signal UnderF, and transmits the mask signal MASK whose level is low to the clock mask circuit 112*b* and the clock counter circuit 114*b*.

Since the mask signal MASK is a low level, the clock mask circuit 112*b* transmits the inputted clock PCLK to the display device 12 as the display clock PCLK'. Also, since the mask signal MASK is a low level, the clock counter circuit 114*b* counts up the counter value by 1 at a rising edge of the inputted clock PCLK ("240"→"241"→ . . . →"247"→"0").

When the pixel counter value becomes "245" because the clock counter circuit 114*b* counts up the counter value at the time t412, the enable signal generating circuit 115 lowers the data enable signal DataEn to a low level.

When the pixel counter value becomes "0" because the clock counter circuit 114*b* counts up the counter value at the time t413, the horizontal synchronizing signal generating circuit 116 lowers the horizontal synchronizing signal Hsync to a low level.

(Operation of CPU)

Figure 9:
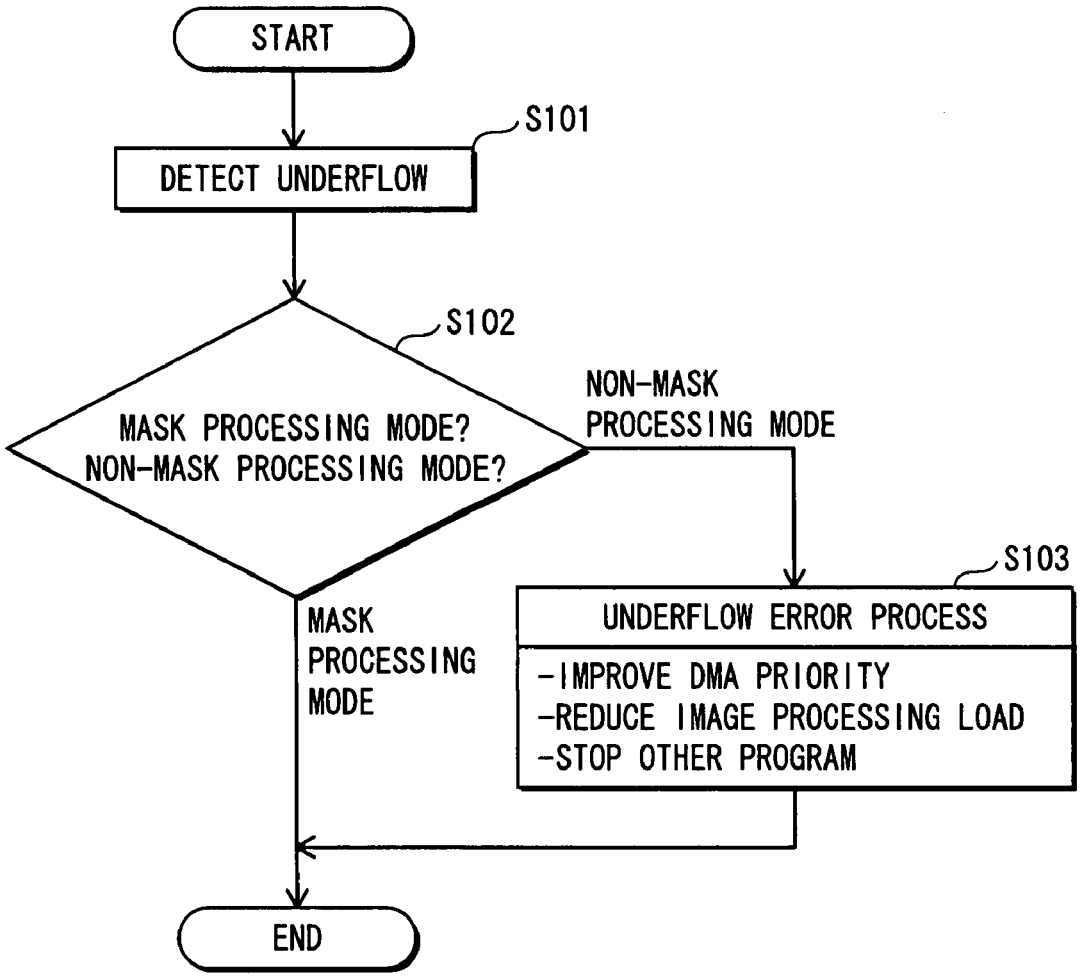
FIG. 9 is a flowchart showing an operation of a CPU in FIG. 6.
Figure 10A:
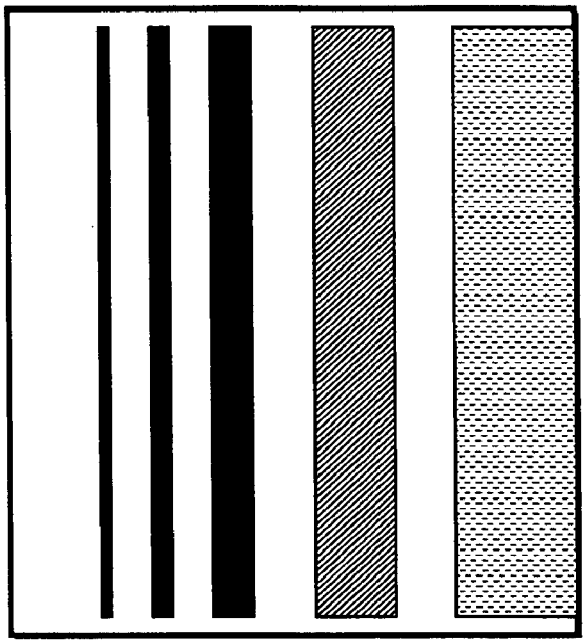
FIG. 10A PRIOR ART
FIGS. 10A and 10B are diagrams for explaining a conventional problem.
Figure 10B:
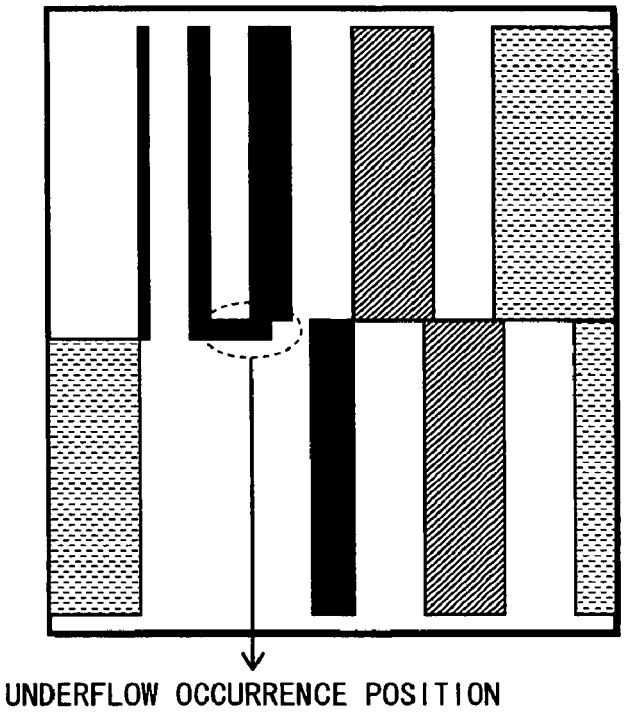
FIG. 10B PRIOR ART

The following describes an operation of the CPU 15 of the display system 1 in FIG. 6 with reference to FIG. 9. FIG. 9 is a flowchart showing the operation of the CPU 15.

The CPU 15 monitors the notification signal UnderF inputted from the FIFO circuit 111, i.e. monitors the occurrence of underflow in the FIFO circuit 111. Then, the CPU 15 detects that the notification signal UnderF becomes a high level while monitoring, i.e. detects that underflow occurs in the FIFO circuit 111 (step S101). The CPU 15 judges whether the display control circuit 31 operates in the mask processing mode or in the non-mask processing mode, based on the register value inputted from the clock mask setting register 311 (step S102). When judging that the display control circuit 31 operates in the mask processing mode (step S102: mask processing mode), the CPU 15 ends the process in FIG. 9. When judging that the display control circuit 31 operates in the non-mask processing mode (step S102: non-mask processing mode), the CPU 15 performs the underflow error process (step S103), and ends the process in FIG. 9.

<Effect>

In the display system 3 of the above-mentioned third embodiment, when underflow occurs in the FIFO circuit 111, the display control circuit 31 can be used for both the mask processing mode for masking the clock PCLK and the non-mask processing mode for not masking the clock PCLK. As a result, an improvement of cost performance caused by mass production can be expected.

If a user would like to apply the same control flow as a type without the function of the present invention to the display control software, and make a screen display state when underflow occurs the same state as the type without the function of the present invention, it can be realized by selecting the non-mask mode. Because of this, the same software can be applied to many types and the same display result can be obtained. Therefore, an improvement of development efficiency can also be expected.

Note that an example of a digital interface is shown in the first, second, and third embodiments, as an interface with the display device 12. However, the present invention is also effective for a case in which the interface is converted into a low-voltage differential serial interface. Also, it is essentially same to slow a frequency of a pixel clock by inputting a state a little before underflow of the display data.

<<Supplement>>

The present invention is not limited to the first, second, and third embodiments. For example, the following is a modification.

The clock mask setting register 311 and the mask signal generating circuit 312 described in the third embodiment may be incorporated into the display control circuit 21 in the second embodiment.

INDUSTRIAL APPLICABILITY

The present invention can be used for a display control device for displaying display data in a display of a display device, and a display system including the display control device.

The invention claimed is:

1. A display control circuit for controlling a display of a display device, the display control circuit comprising:

a data transfer circuit that stores data which is sequentially inputted thereto and transmits the stored data to the display device in accordance with an inputted clock signal;

a clock mask circuit that transmits the inputted clock signal to the display device as a display clock signal while data to be transmitted is stored in the data transfer circuit, and transmits an edge-masked and fixed level signal to the display device as the display clock signal while no data to be transmitted is stored in the data transfer circuit;

a clock counter circuit that performs a count operation of counting a number of clocks of the inputted clock signal while data to be transmitted is stored in the data transfer circuit, and stops the count operation while no data to be transmitted is stored in the data transfer circuit; and a horizontal synchronizing signal generating circuit that generates a horizontal synchronizing signal having a first level when a counter value of the clock counter circuit is in a predetermined range and a second level when the counter value is out of the predetermined range, the first level being different from the second level, and transmits the generated horizontal synchronizing signal to the display device.

2. The display control circuit of claim 1, further comprising:

a mask period counter circuit that counts the number of clocks of the inputted clock signal while no data to be transmitted is stored in the data transfer circuit; and a correcting circuit that corrects an upper limit value in a count range of the clock counter circuit to a value obtained by subtracting a counter value of the mask period counter circuit from the upper limit value, wherein the clock counter circuit performs the count operation in a count range determined as a result of the correction by the correcting circuit.

3. A display control circuit for controlling a display of a display device, the display control circuit comprising:

a data transfer circuit that stores data which is sequentially inputted thereto and transmits the stored data to the display device in accordance with an inputted clock signal; and a clock mask circuit that transmits the inputted clock signal to the display device as a display clock signal while data to be transmitted is stored in the data transfer circuit, wherein the display control circuit is capable of switching an operation between a first operation and a second operation, the operation being performed while no data to be transmitted is stored in the data transfer circuit, wherein the display control circuit further comprises:

an operation setting circuit that records any of information indicating the first operation and information indicating the second operation, and wherein while no data to be transmitted is stored in the data transfer circuit, the clock mask circuit transmits the edge-masked and fixed level signal to the display device as the display clock signal when the information indicating the first operation is recorded in the operation setting circuit, and transmits the inputted clock signal to the display device as the display clock signal when the information indicating the second operation is recorded in the operation setting circuit.

* * * * *